US005618198A

United States Patent [19]

Sato et al.

[11] Patent Number: 5,618,198

[45] Date of Patent: Apr. 8, 1997

[54] WATERPROOF CONNECTOR

[75] Inventors: Kensaku Sato; Naohisa Nakata, both of Tokyo, Japan

[73] Assignee: Hirose Electric Co., Ltd., Tokyo, Japan

[21] Appl. No.: 527,981

[22] Filed: Sep. 14, 1995

[30] Foreign Application Priority Data

Sep. 27, 1994 [JP] Japan ..... 6-256136

[51] Int. Cl.[6] ..... H01R 13/52

[52] U.S. Cl. ..... 439/274; 439/279

[58] Field of Search ..... 439/587–589, 439/274–279, 523

[56] References Cited

U.S. PATENT DOCUMENTS

| | | | |
|---|---|---|---|
| 4,776,813 | 10/1988 | Wilson et al. | 439/587 |
| 4,797,122 | 1/1989 | Kuboi et al. | 439/589 |
| 5,192,233 | 3/1993 | Suffredini et al. | 439/936 |
| 5,266,045 | 11/1993 | Yamamoto et al. | 439/587 |
| 5,299,949 | 4/1994 | Fortin | 439/589 |
| 5,482,299 | 1/1996 | Saito | 439/587 |

*Primary Examiner*—Neil Abrams
*Assistant Examiner*—Brian J. Biggi
*Attorney, Agent, or Firm*—Kanesaka & Takeuchi

[57] ABSTRACT

A waterproof connector includes a housing having front and rear openings; a terminal unit provided in the housing and connected to a cable; and a watertight closure for closing the rear opening of the housing through which the cable is taken out. The watertight closure includes a bowl-like retainer attachable to the rear opening of the housing, the retainer having a bottom with a through hole for taking out the cable and a molding section on the bottom and a plurality of linkage apertures through the molding section, and an elastic seal secured within the retainer by securing portions of the elastic seal provided within the molding section and the linkage apertures and having a second through hole concentric with the first through hole.

4 Claims, 11 Drawing Sheets

FIG. 3 (1)
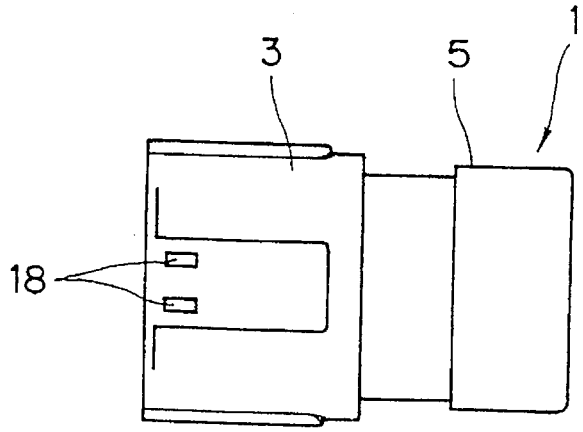
FIG. 3 (2)
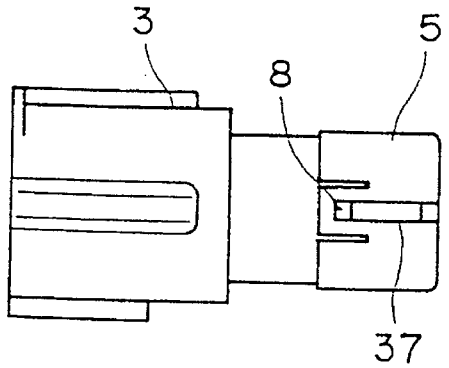
FIG. 3 (3)
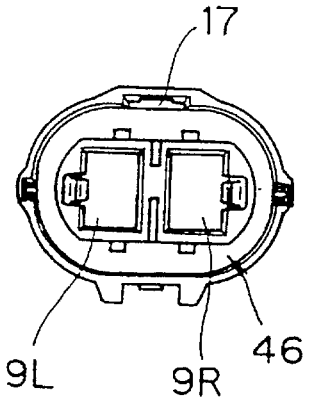
FIG. 3 (4)
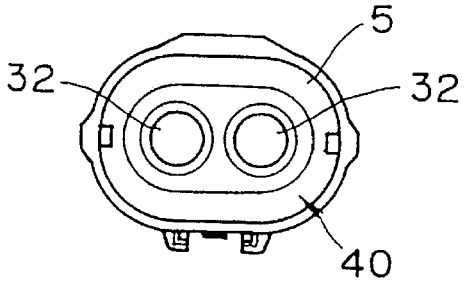

FIG. 6 (1)
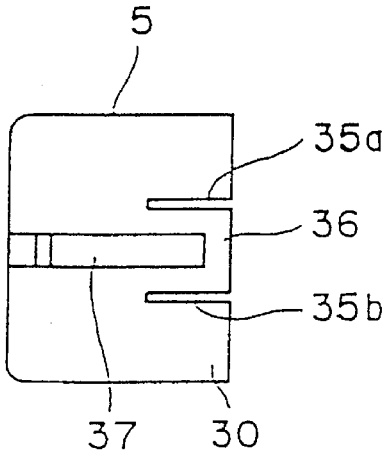
FIG. 6 (2)
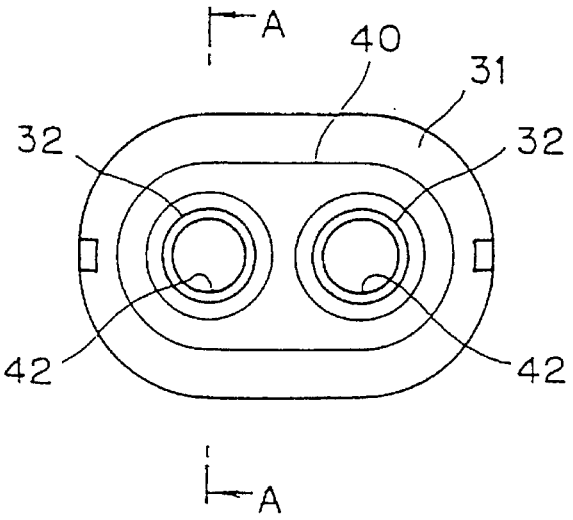
FIG. 6 (3)
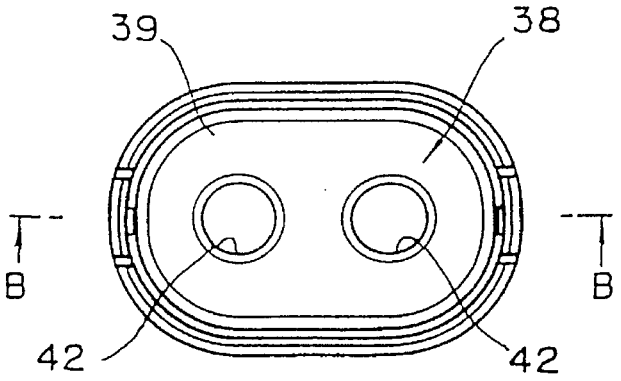

FIG. 10 (1)
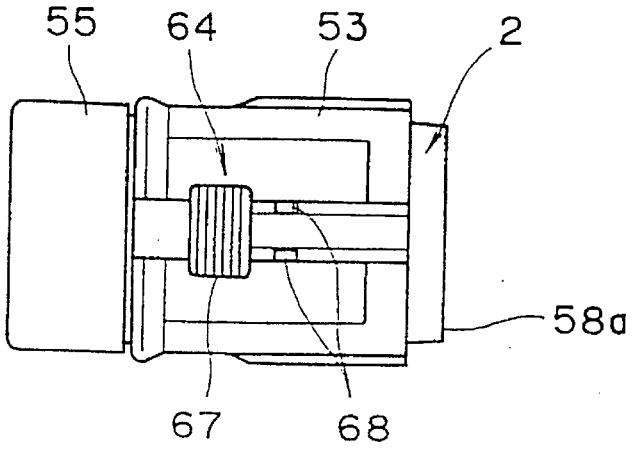
FIG. 10 (2)
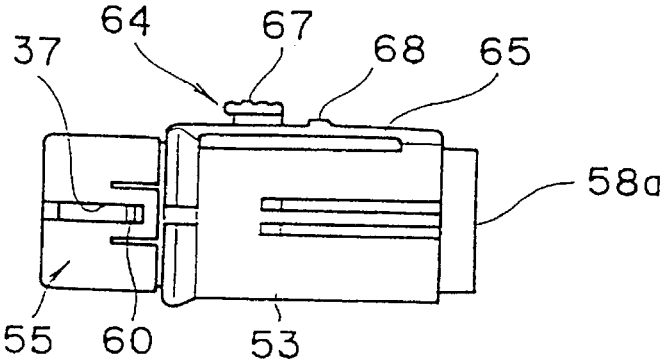
FIG. 10 (3)
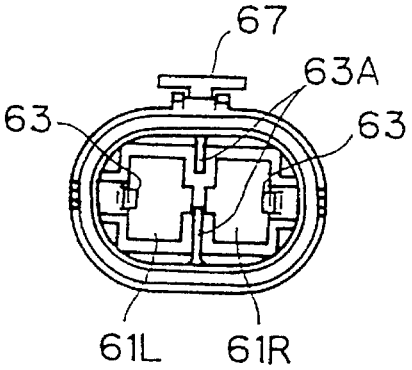
FIG. 10 (4)
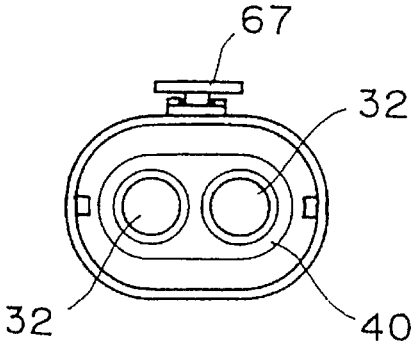

FIG. 14 (1)
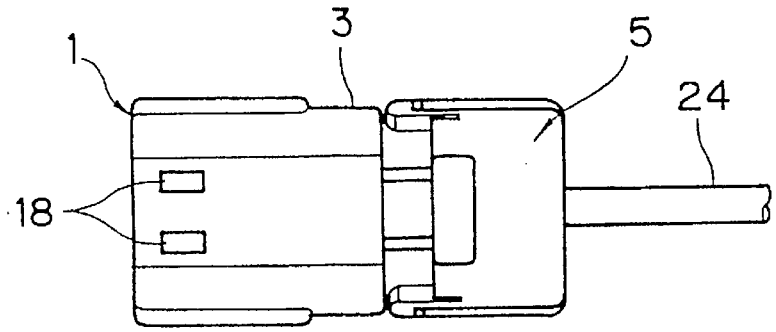
FIG. 14 (2)
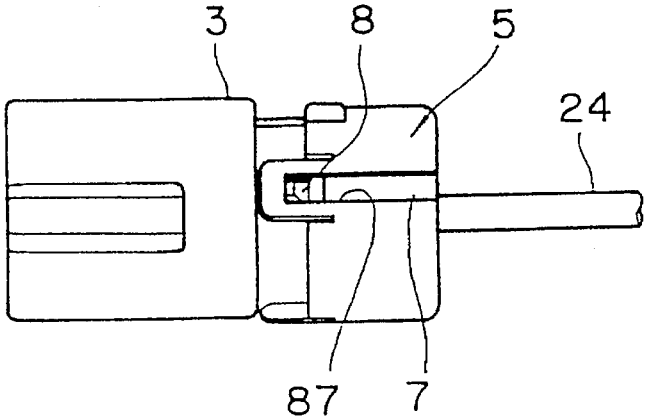
FIG. 14 (3)
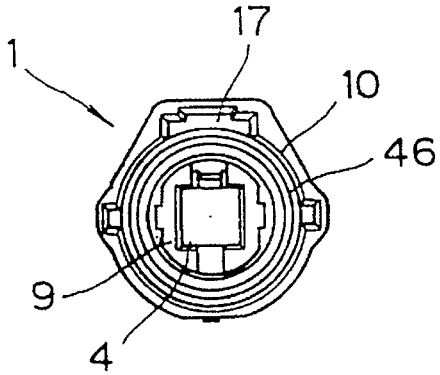

FIG. 15 (1)
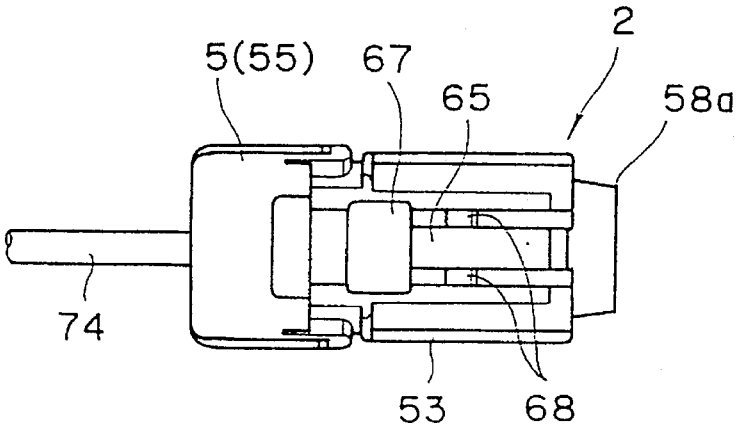
FIG. 15 (2)
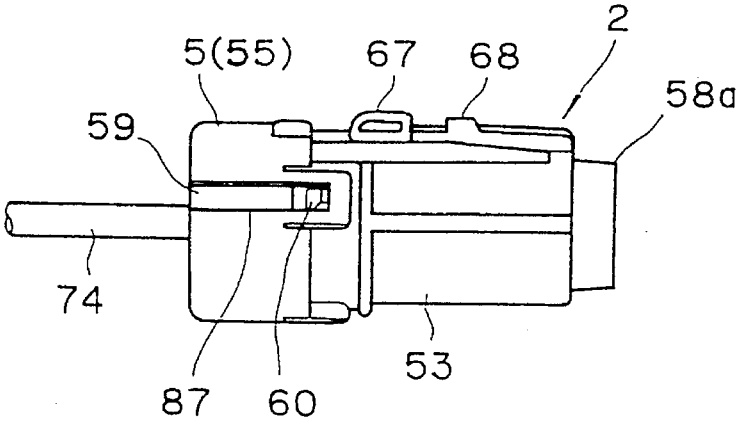
FIG. 15 (3)
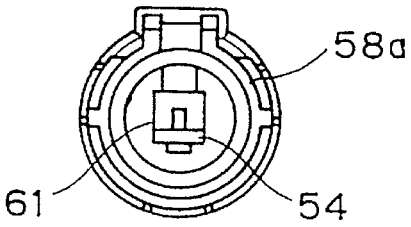

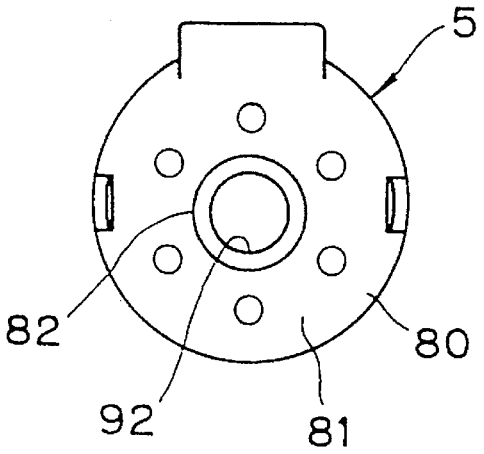
FIG. 16 (1)
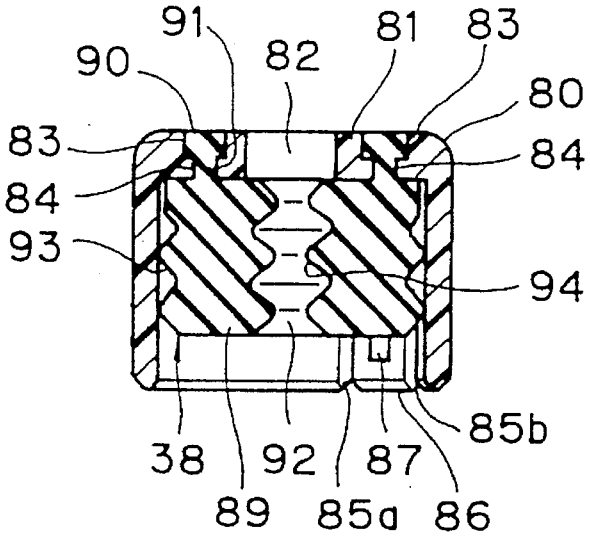
FIG. 16 (2)

WATERPROOF CONNECTOR

BACKGROUND OF THE INVENTION

1. Field of the Invention

The present invention relates to waterproof connectors for use in such a atmosphere that the connectors are exposed to water droplets or the like.

2. Description of the Prior Art

Japanese UM patent application Kokai No. 62-124781 discloses a waterproof connector. The waterproof connector includes an elastic seal ring for closing a gap between the mating connector housings. The elastic seal ring is attached to the connector housing by engaging engaging projections provided on the seal ring with latch apertures and protective walls on the connector housing.

However, in the above waterproof connector, the seal ring is separated from the connector housing before assembling. Consequently, it is frequent to lose the seal ring. In addition, assembling the seal ring to the connector housing increases the manufacturing costs.

SUMMARY OF THE INVENTION

Accordingly, it is an object of the invention to provide a waterproof connector for which it is easy to make the elastic seal thereby increasing the productivity and reducing the manufacturing costs by volume production.

It is another object of the invention to provide a waterproof connector wherein the rear portion and cable outlet portion of the connector are made waterproof without failure and the terminal units are place in the receiving cavities without failure.

According to the invention there is provided a waterproof connector comprising a housing having front and rear openings; a terminal unit provided in the housing and connected to a cable; and watertight means for closing the rear opening of the housing through which the cable is taken out; the watertight means comprising a bowl-like retainer attachable to the rear opening of the housing, the retainer having a bottom with a through hole for taking out the cable and a molding section on the bottom and a plurality of linkage apertures through the molding section, and an elastic seal secured within the retainer by securing portions of the elastic seal provided within the molding section and the linkage apertures and having a second through hole concentric with the first through hole.

According to another aspect of the invention there is provided a waterproof connector which further comprises a plate member placed between the elastic seal and the terminal unit and having a third through hole concentric with the first and second through hole through which the cable is taken out.

The molding section is a recess depressed around the first through hole or comprises independent recesses depressed around the linkage apertures.

The main body of an elastic seal is secured to the inside of the retainer by means of the securing portions in the molding section and the linkage portions in the linkage apertures of the retainer so that it is easy to make the elastic seal. The elastic seal is molded to the retainer so that the possibility to lose it is minimized, the productivity is increased, and the manufacturing cost is reduced by volume production.

The plate member is placed between the main body of the elastic seal and the terminal unit while the cable is taken out the through holes of the plate member, the elastic seal, and the retainer so that the plate member is pressed by the terminal unit to press the main body of the elastic seal. Consequently, the circumferential face of the main body is pressed against the inside face of the connector housing while the circumferential face of the through hole of the main body is pressed against the cable. Thus, the rear portion and cable outlet portion of the connector is made waterproof.

The terminal unit is pushed into the receiving cavity by the elastic seal via the plate member so that the attachment of the terminal unit to the receiving cavity is assured (double engagement).

Where the molding section is a recess depressed around the through hole in the retainer bottom, the securing section of the elastic seal becomes continuous to provide large securing power so that the elastic seal of a large waterproof connector is secured without failure.

Where the molding section comprises recesses around the linkage apertures, the respective independent securing sections of the elastic seal secure the elastic seal to a compact waterproof connector.

The above and other objects, features, and advantages of the invention will be more apparent from the following description when taken in conjunction with the accompanying drawings.

BRIEF DESCRIPTION OF THE DRAWINGS

FIGS. 3(1), (2), (3), and (4) are top, side, front, and rear views of the male connector from which the terminal unit is removed;

FIGS. 6(1), (2), and (3) are side, rear, and front views of a retainer for the male connector;

FIGS. 10(1), (2), (3), and (4) are top, side, front, and rear views of the female connector;

FIGS. 14(1), (2), and (3) are top, side, and front views of the male connector;

FIGS. 15(1), (2), and (3) are top, side, and front views of the female connector;

FIGS. 16(1) and (2) are rear and sectional views of a retainer for the connector.

DESCRIPTION OF THE PREFERRED EMBODIMENT

Figure 1:
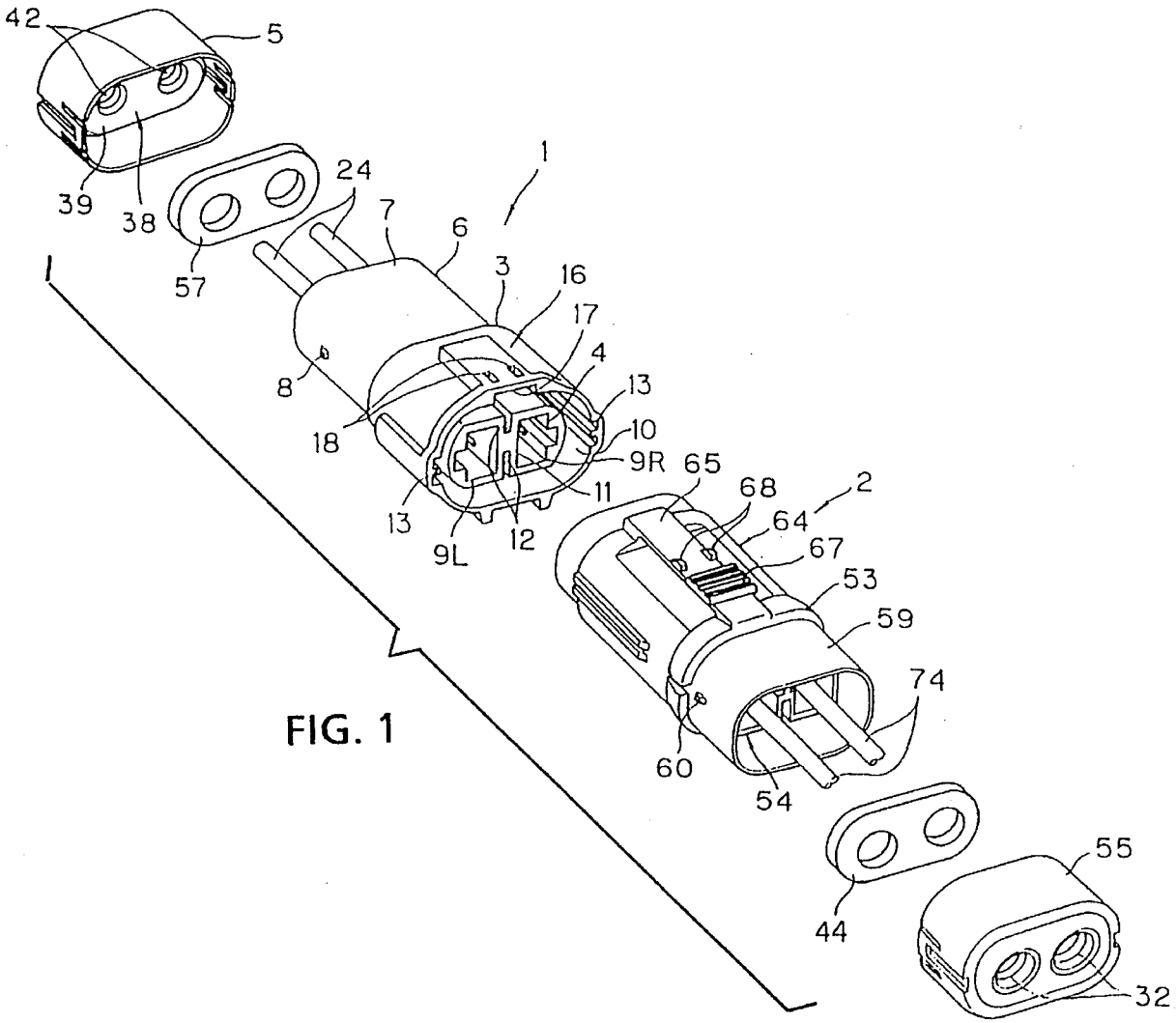
FIG. 1 is an exploded perspective view of a waterproof connector according to an embodiment of the invention.
Figure 2:
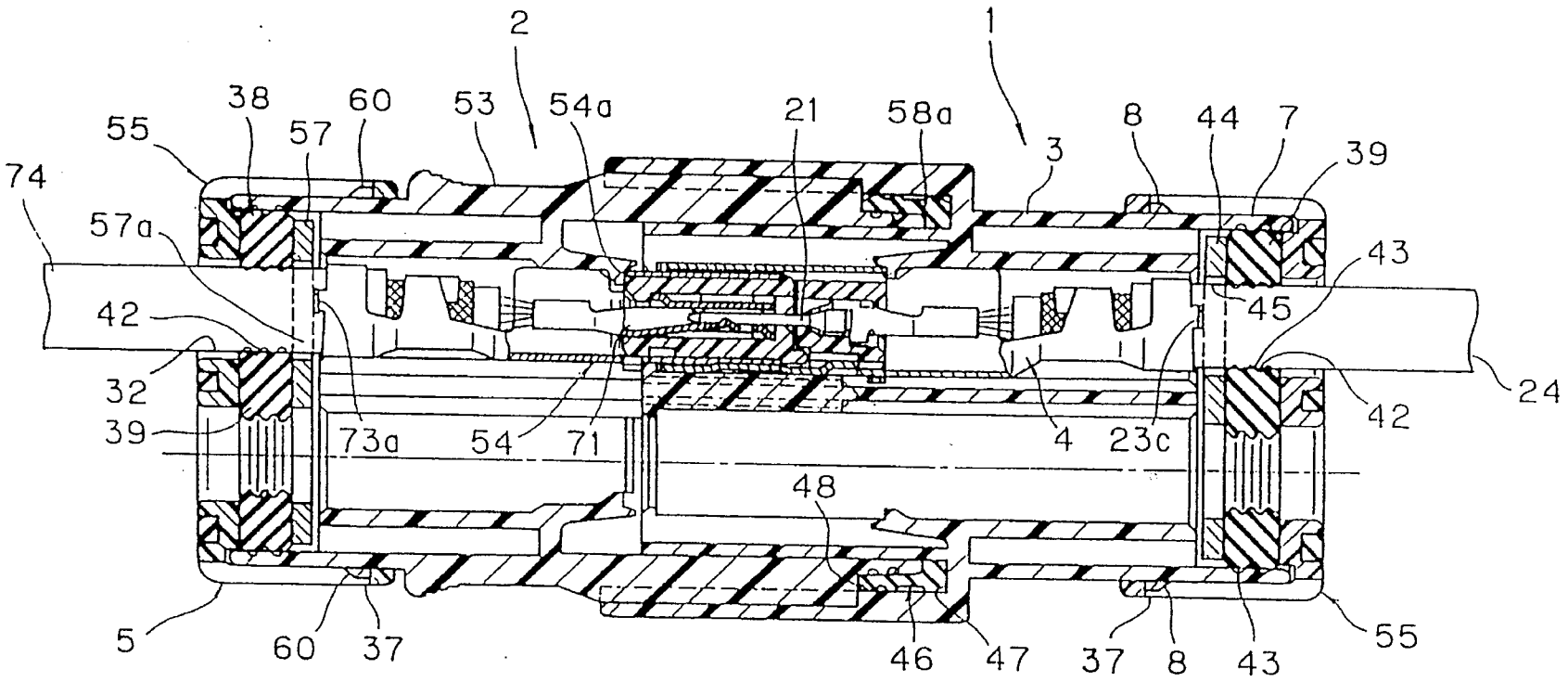
FIG. 2 is a sectional view of male and female connectors under mating conditions.
Figure 4:
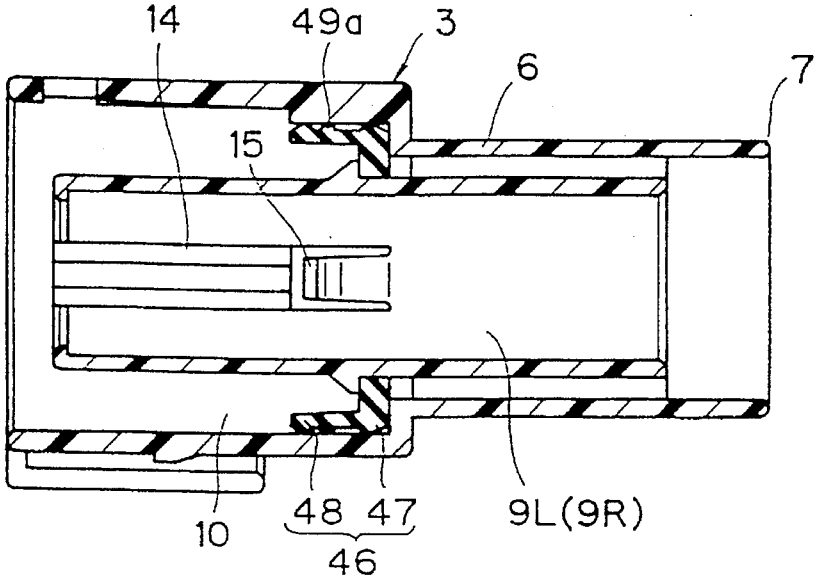
FIG. 4 is a sectional view of a housing of the male connector.

FIG. 1 is a explosive perspective view of a waterproof connector according to an embodiment of the invention. FIG. 2 is a sectional view of male and female connectors of the waterproof connector under connected conditions. FIGS. 3(1), (2), (3), and (4) are top, side, front, and rear views of the male connector. FIG. 4 is a sectional view of a connector housing for the male connector.

The waterproof connector consists of a male connector 1 and a female connector 2. The male connector 1 includes a connector housing 3, a male terminal unit 4, a retainer 5, an elastic seal 38 provided within the retainer 5, a plate member 44, and an inner elastic seal 46.

In FIGS. 3 and 4, the connector housing 3 includes a cylindrical housing body 6 having an oval cross section. The housing body 6 has a rear retainer section 7 with latch projections 8 on opposite sides thereof. Left and right terminal unit receiving cavities 9L and 9R are provided in the housing body 6 such that a fitting space 10 is formed between the terminal unit receiving cavities 9L and 9R and the housing body 6. Upper and lower guiding grooves 12 are provided between the left and right receiving cavities 9L and 9R. Guiding channels 13 are provided on opposite sides of the fitting space 10. Grooves 14 and lances 15 are provided on the inner surfaces of outer side walls of the receiving cavities 9L and 9R.

A male lock 16 is provided on the top of the connector housing 3. The male lock 16 has an insertion channel 17 and lock apertures 18 provided in the top wall of the insertion channel 17.

Figure 5:
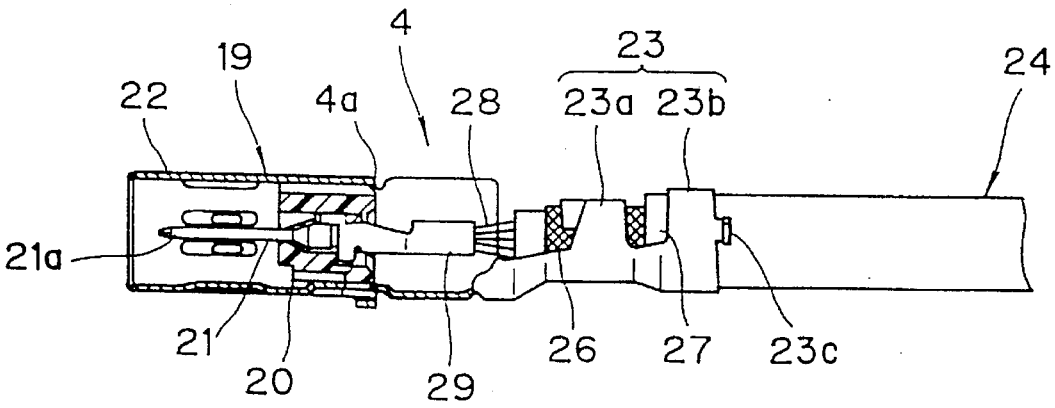
FIG. 5 is a partially cutaway side view of a terminal unit for the male connector.
Figure 8:
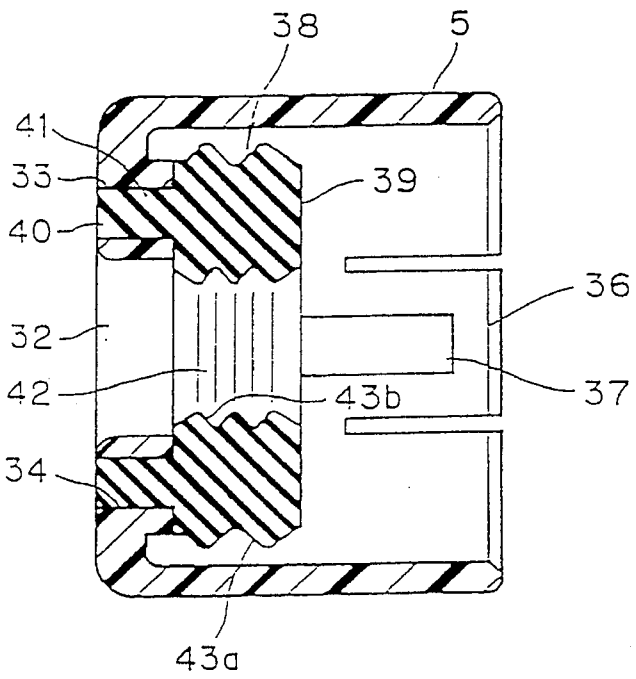
FIG. 8 is a sectional view taken along line A—A of FIG. 6(2)
Figure 7:
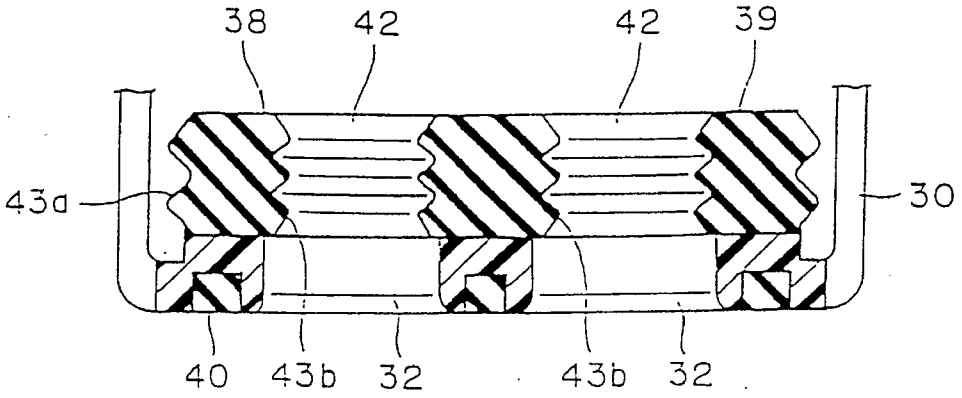
FIG. 7 is a sectional view taken along line B—B of FIG. 6(3)
Figure 9:
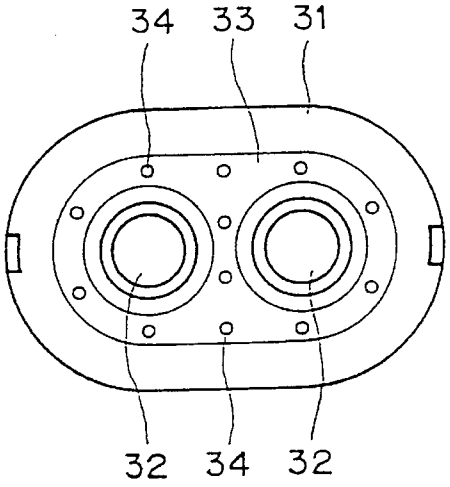
FIG. 9 is a rear view of a main body of the retainer.

In FIG. 5, the male terminal unit 4 includes a shield member 19, an insulation block 20, and a male terminal 21. The shield member 19 has a tubular shield section 22 and a crimping section 23, which has a shield crimping tabs 23*a* and a jacket crimping tabs 23*b*. The male terminal 21 is supported by the insulation block 20 in the shield section 22. The crimping section 23 is connected to an electrical cable 24 with the shield crimping tabs 23*a* and the jacket crimping tabs 23*b* crimped on the shield wires 26 and the jacket 27 of the cable 24. The crimping tabs 29 of the male terminal 21 are crimped on the core wires (inner conductors) 28 of the cable 28.

FIGS. 6–9, the retainer 5 includes a bowl-like retainer body 30 with left and right wire through holes 32 provided in the bottom 31. A support section 33 is provided on the bottom 31 between its circumferential edge and the through holes 32. A plurality of linkage apertures 34 are provided in the support section 33 around the through holes 32. Slits 35*a* and 35*b* are provided on opposite side walls of the retainer body 30 to form piece members 36 with a latch slot 37 provided therein.

An elastic seal 38 made of waterproof rubber (silicone rubber) is molded in the support section 33 of the retainer body 30. That is, inner and outer mold dies are provided around the retainer 5 and rubber is poured into the mold to form an integrally molded seal 38. The rubber flows into the support section 33 through the linkage apertures 34. Thus, a main body 39 having a shape similar to the interior of the retainer body 30, securing portions 40, and linking portions 41 are formed on the inside of the bottom of the retainer body 30, an outside of the retainer body 30, and within the linkage apertures 34, respectively.

Consequently, the main body 39 is secured closely to the retainer body 30 by the securing portions 40 via the linking portions 41. Left and right through holes 42 are provided in the main body 39. Lip portions 43*a* and 43*b* are provided on circumferential surfaces of the through holes 42 and the main body 39.

The plate member 44 has a front shape similar to that of the main body 39 and left and right through holes 45 therein.

In FIGS. 2 and 4, the inner elastic seal 46 is to be fitted in the fitting space 10 between the housing body 6 and the receiving cavities 9L and 9R and has an annular base section 47 having a front shape similar to the fitting space 10 and a cylindrical section 48. A plurality of lip members 49*a* are provided on the outside of the cylindrical section 48.

The male terminal units 4 are inserted in the receiving cavities 9L and 9R such that the lances 15 are engaged with the lance engaging shoulder 4*a* of the male terminal units 4. The retainer 5 is fitted over the retainer section 7 of the connector housing 3 such that the latch projections 8 of the retainer section 7 engage the latch apertures 37 of the retainer body 30.

The plate member 44 is placed between the main body 39 of the seal 38 and the rear end of the receiving cavities 9L and 9R. The cable 24 connected to the terminal unit 4 is led to outside through the through holes 45, 42, and 32 of the plate member 44, the main body 39, and the retainer body 30. The plate member 44 is pushed rearwardly by the push member 23*c* provided on the rear edge of the crimping tabs 23 of the terminal unit 4 to press the main body 39 of the seal 38 so that the lip members 43*a* of the main body 39 are brought into close contact with the retainer section 7 of the connector housing 5. Similarly, the lip members 43*b* around the through holes 42 are brought into close contact with the cable 24, forming a watertight closure to make waterproof the rear section of the female connector 2 and the cable outlet portions.

The male terminal units 4 are fitted into the receiving cavities 9L and 9R by reactive forces from the main body 39 of the seal 38 via the plate member 44, thus attachment of the male terminal unit 4 in the fitting in the receiving cavities 9L and 9R (double engaging).

The inner elastic seal 46 is placed on the bottom of the fitting space 10 to complete the male connector 1.

The female connector 2 includes a connector housing 53, a female terminal unit 54, a retainer 55, an elastic seal 38 provided in the retainer 55, and a plate member 57.

Figure 11:
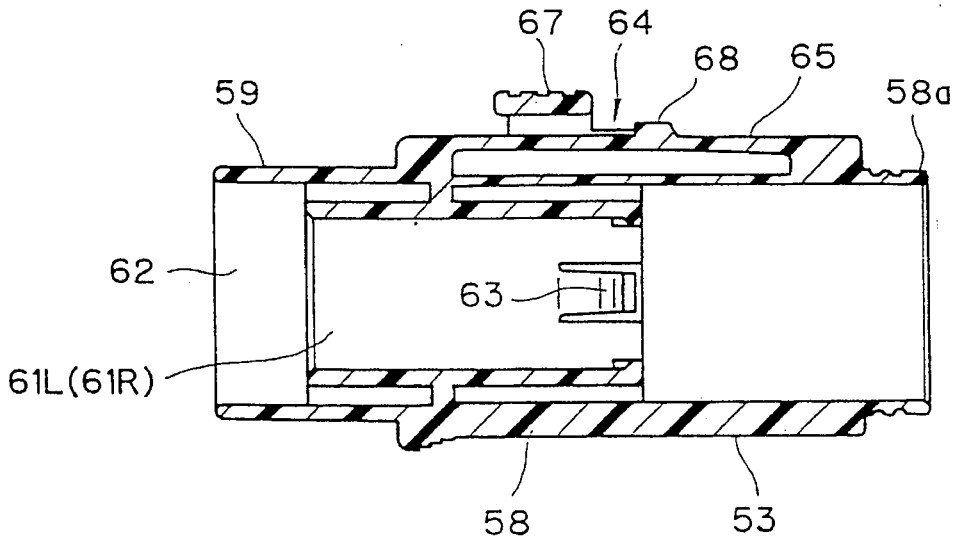
FIG. 11 is a sectional view of a connector housing for the female connector.

In FIGS. 10 and 11, the connector housing 53 has a tubular housing body 58 with an oval cross section. The housing body 58 has a front push portion 58*a* and a rear retainer section 59 having latch projections 60 on opposite sides thereof. The housing body 58 has left and right terminal unit receiving cavities 61L and 61R and a partition wall 63A between them. Lances 63 are provided on the inner surfaces of an outer walls of the left and right terminal unit receiving cavities 61L and 61R.

A female lock 64 is provided on the top of the connector housing 53. The female lock 64 includes a flexible arm 65 joined to the connector housing 53 at opposite ends and having a release button 67 and latch projections 68 provided thereon.

Figure 12:
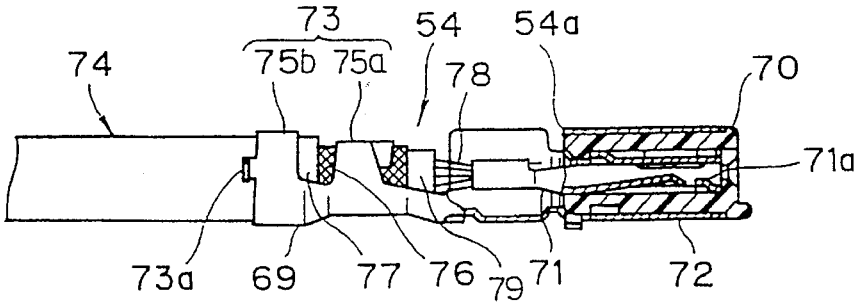
FIG. 12 is a partially cutaway side view of a female terminal unit.

In FIG. 12, the female terminal unit 54 includes a shield member 69, an insulation block 70, and a female terminal 71. The shield member 69 includes a shield tubular section 72 and a crimping section 73 which has shield crimping tabs 75*a* and jacket crimping tabs 75*b*. The female terminal 71 is supported by the insulation block 70 in the shield tubular section 72. The shield crimping tabs 75*a* and the jacket crimping tabs 75*b* are crimped on the shields 76 and the jacket 77 of a cable 74, respectively. A crimping section 79 of the female terminal 71 is crimped on the core wires (inner conductors) of the cable 74.

The retainer section 55 has the same structure as that of the retainer section 5. The elastic shield member of the retainer 55 has the same structure as that of the elastic shield member 38. Also, the plate member 57 is identical with the plate member 44.

The female terminal units 54 are placed in the receiving cavities 61L and 61R of the connector housing 53 such that the lances 63 engage the lance shoulder 54*a* of the terminal unit 54. The retainer 55 is fitted over the retainer section of the connector housing 53 such that the latch projections 60 engage the latch apertures 37 of the retainer 55.

The plate member 57 is placed between the main body 39 of the elastic seal 38 and the rear ends of the receiving cavities 61L and 61R while the cable 74 connected to the female terminal unit 54 is led to outside via the through holes 57*a*, 42, and 32 of the plate member 57, the elastic seal 38, and the retainer body 30, respectively. The plate member 57 is pushed by the pushing member 73*a* of the crimping section 73 to press the main body 39 of the elastic seal 38 while the lip members 43*a* of the main body 39 are brought into close contact with the inner surface of the retainer section 59 of the connector housing 53. The lip members 43*b* around the through holes 42 of the main body 39 are brought into close contact with the cable 74 to form a watertight closure, thus making waterproof the cable outlet and the rear section of the female connector 2.

The female terminal units 54 are pushed into the receiving cavities 61L and 61R by reactive forces of the main body 39 of the elastic seal 38 via the plate member 57, thus assuring attachment (double engagement) of the female terminal units 54 in the receiving cavities 61L and 61R.

How to connect and disconnect the male and female connectors 1 and 2 will be described below.

The front portion of the female connector 2 is fitted into the fitting space 10 of the male connector 1 such that the shield tubular section 72 of the female connector 2 is fitted into the shield tubular section 22 of the male connector 1 to bring the contact portions 71*a* of the female connector 2 into contact with the contact portions 21*a* of the male connector 1. At the same time, the flexible member 65 and the release button 67 of the female lock 64 are inserted into the channel section 17 of the male lock 16 such that the lock projections 68 engage the lock apertures 18 to connect the female and male connectors 2 and 1, wherein the pushing portion 58*a* of the female connector 2 is pressed against the elastic seal 46, making the interior waterproof.

To disconnect the female and male connectors 2 and 1, the release button 67 is depressed to deflect the flexible arm 65 so that the lock projections 68 are released from the lock apertures 18, thus permitting the female connector 2 to be pulled out of the male connector 1.

Figure 13:
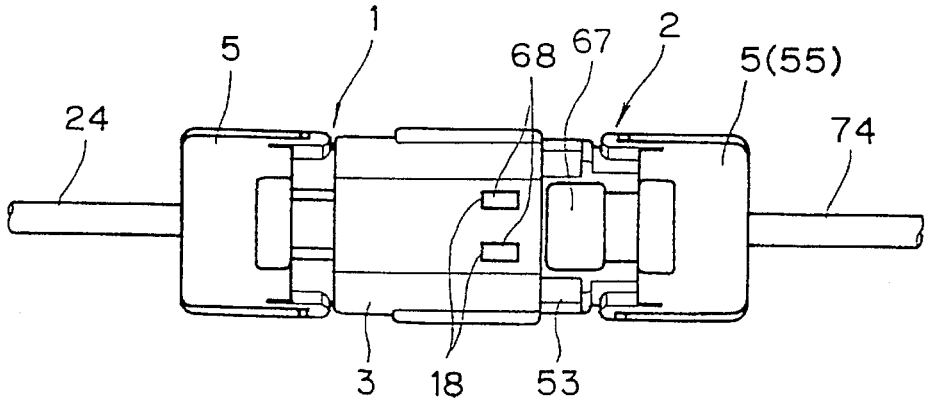
FIG. 13 is male and female connectors of a waterproof connector under mating conditions according to another embodiment of the invention.

In FIG. 13, a waterproof connector according to another embodiment of the invention consists of a male connector 1 and a female connector 2. The male connector 1 has a male terminal unit 4 while the female connector 2 has a female terminal unit 54. The male connector 1 is substantially the same as that of the first embodiment except for the number of terminal units 4 and the structure of a receiving cavity 9, a retainer 5, and an elastic seal 38. Accordingly, only the structures of the retainer 5 and the elastic seal 38 will be described below.

In FIG. 16, the retainer 5 has a bowl-like retainer body 80 with the bottom 81 having a through hole 82 therein. An annular molding section 83 is provided around the through hole 82. Linkage apertures 84 are provided in the annular molding section 83. Slits 85*a* and 85*b* are provided on opposite sides of the retainer body 80 to form piece members 86 with a latch aperture 87.

An elastic seal 38 made of waterproof rubber (silicone rubber) is molded in the retainer body 80. That is, molding dies are provided around the retainer 5 and rubber is poured into the mold to integrally mold the elastic seal 38. The rubber flows through the linkage apertures 84 into the molding section 83 to form a main body 89 of the elastic seal 38 which has a configuration similar to that of the retainer body 80 and securing sections 90 within the molding section 83, with linkage sections 91 within the linkage apertures 84.

Consequently, the main body 89 of the elastic seal 38 is held by the securing section 90 through the linkage portions 91 in closely contact with the retainer body 80. A through hole 92 is provided in the main body 89 of the elastic seal 38. Lip members 93 and 94 are provided on the through hole 92 and the circumferential surface of the main body 89.

The male terminal unit 4 is placed in the receiving cavity 9 of the connector housing 3. The retainer 5 is fitted over the retainer section 7 of the connector housing 3 such that the latch projections 8 of the retainer section 7 engage the latch apertures 87 of the retainer body 80.

The main body 89 of the elastic seal 38 is pressed against the rear end of the receiving cavity 9 of the connector housing 3 while the cable 24 connected to the terminal unit 4 is led to outside via the through holes 92 and 82 of the elastic seal 38 and the retainer body 80. The main body 89 of the elastic seal 38 is pressed against the rear end of the receiving cavity 9 so that the lip members 93 and 94 are brought into close contact with the retainer section 7 of the connector housing 5 and the cable 24, respectively, forming a watertight closure thus making waterproof the rear portion of the female connector 2 and the cable out let portion.

The inner elastic seal 46 is placed deep in the fitting space 10 between the housing body 6 of the connector housing 3 and the terminal unit receiving cavity 9, forming the male connector 1.

The female terminal unit 54 is placed in the receiving cavity 61 of the connector housing 53. The retainer 55 is fitted over the retainer section 59 of the connector housing 53 such that the latch projections 60 engage the latch apertures 87 of the retainer body 80.

The main body 39 of the elastic seal 38 is pressed against the receiving cavity 61 of the connector housing 53 while the cable 74 connected to the terminal unit 54 is led to outside via the thorough holes 92 and 82 of the elastic seal 38 and the retainer body 80. The lip members 93 and 94 are pressed against the retainer 59 of the connector housing 53 and the cable 74, respectively, forming a watertight closure thus making waterproof the rear portion of the female connector 2 and the cable outlet portion.

The inner elastic seal 46 is pressed against the pressure portion 58*a* of the female connector 2, making the interior waterproof. To disconnect the female and male connectors 2 and 1, the release button 67 is depressed to deflect the flexible arm 65 such that the lock projections 68 are released from the lock apertures 18 thereby permitting the female connector 2 to be pulled out of the male connector 1.

The terminal unit 54 is pushed into the receiving cavity 61 by reactive forces from the elastic seal 83 thereby assuring the attachment of the female terminal units 54 to the receiving cavity 61 (double engagement).

As has been described above, according to the invention there is provided a waterproof connector which has watertight closures at the ends of the connector housings and cable outlets of the male and female connectors. The watertight closures include a retainer with linkage apertures and an elastic seal molded in the retainer such that the main body is held by the securing section linked to the main body by linkage portions.

Consequently, it is made easy to make the elastic seal. In addition, the elastic seal is attached to the retainer permanently, so that the possibility of losing the elastic seal is eliminated, the productivity of the waterproof connector is increased, and that the manufacturing costs are reduced by volume production.

According to the invention, the cable is led to outside via the through holes of the plate member between the elastic seal and the terminal unit, the elastic seal, and the retainer so that the plate member is pressed against the terminal unit which, in turn, presses the elastic seal against the interior of the connector housing. Also, the elastic seal is pressed against the cable, making waterproof the rear portion of the connectors and the cable outlet portions.

The terminal unit is pushed into the receiving cavity by reactive forces of the elastic seal, so that the attachment of the terminal unit in the receiving cavity is assured (double engagement).

Where the molding section is an annular section depressed around the through hole on the retainer bottom, the securing portions of the elastic seal are continuous to provide large securing power thereby assuring hold of an elastic seal for a large waterproof connector.

Where the molding section is annular sections depressed around the linkage apertures in the retainer bottom, the respective independent holding sections of the elastic seal assure hold of the elastic seal of a compact waterproof connector.

What is claimed is:

1. A waterproof connector comprising:

a housing having front and rear openings;

a terminal unit provided in said housing and connected to a cable; and watertight means for tightly closing said rear opening of said housing through which said cable is taken out in a watertight fashion;

said watertight means comprising:

a bowl-like retainer attachable to said rear opening of said housing, said retainer having a bottom with a through hole for taking out said cable and a molding section on said bottom and a plurality of linkage apertures through said molding section, and an elastic seal integrally molded on said molding section through said linkage apertures and having a second through hole concentric with said first through hole so that said elastic seal and said retainer are joined as a unit.

2. A waterproof connector according to claim 1, which further comprises a plate member placed between said elastic seal and said terminal unit and having a third through hole concentric with said first and second through holes through which said cable is taken out.

3. A waterproof connector according to claim 1, wherein said molding section has a recess provided on an outside of said molding section around said first through hole.

4. A waterproof connector according to claim 1, wherein said molding section comprises independent recesses provided on an outside of said molding section around said linkage apertures.

* * * * *